US006692335B2

(12) United States Patent
Watkins

(10) Patent No.: US 6,692,335 B2
(45) Date of Patent: Feb. 17, 2004

(54) STREAMER AND LAUNCHER

(76) Inventor: James O. Watkins, 9416 Tobin Cir., Patomac, MD (US) 20854

( * ) Notice: Subject to any disclaimer, the term of this patent is extended or adjusted under 35 U.S.C. 154(b) by 0 days.

(21) Appl. No.: 09/790,981

(22) Filed: Feb. 23, 2001

(65) Prior Publication Data

US 2002/0013119 A1 Jan. 31, 2002

Related U.S. Application Data

(63) Continuation-in-part of application No. 09/603,562, filed on Jun. 26, 2000.

(60) Provisional application No. 60/141,118, filed on Jun. 25, 1999.

(51) Int. Cl.[7] ..... A63H 33/30

(52) U.S. Cl. ..... 446/475; 446/491; 124/5; 428/906

(58) Field of Search ..... 446/475, 491; 206/391, 394, 398, 407; 428/906; 124/5

(56) References Cited

U.S. PATENT DOCUMENTS

| | | | | |
|---|---|---|---|---|
| 5,354,227 A | | 10/1994 | Watkins | 446/475 |
| 5,403,225 A | | 4/1995 | Watkins | 446/475 |
| 5,556,319 A | | 9/1996 | Watkins | 446/475 |
| 5,620,354 A | | 4/1997 | Watkins | 446/475 |
| 5,624,295 A | | 4/1997 | Watkins | 446/475 |
| 5,643,042 A | | 7/1997 | Watkins | 446/475 |
| 5,709,584 A | | 1/1998 | Watkins | 446/475 |
| 5,714,210 A | | 2/1998 | Watkins | 428/7 |
| 5,807,159 A | | 9/1998 | Watkins | 446/475 |
| 5,823,850 A | * | 10/1998 | Watkins | 124/5 |

FOREIGN PATENT DOCUMENTS

| | | | |
|---|---|---|---|
| FR | 625670 A | * | 8/1927 |

* cited by examiner

*Primary Examiner*—Derris H. Banks
*Assistant Examiner*—Urszula M Cegielnik
(74) *Attorney, Agent, or Firm*—Bartlett & Sherer; Ronald B. Sherer

(57) ABSTRACT

A manual system and method is disclosed for launching streamers into the air such as from a hollow tube in which the streamers are positioned in particular manners.

4 Claims, 2 Drawing Sheets

STREAMER AND LAUNCHER

RELATED APPLICATIONS

This Application is a Continuation-In-Part of application Ser. No. 09/603,562 filed Jun. 26, 2000 having a Provisional application Ser. No. 60/141,118 Filing Date of Jun. 25, 1999.

BACKGROUND

U.S. Pat. No. 5,403,225 relates to the launching of confetti in the form of hundreds or thousands of pieces of confetti stacked across the internal diameter of a tube by manually moving the tube in an arcuate path so that centrifugal force ejects the stacks of confetti and projects them upwardly into the air. However, the launching of streamers has been difficult, even when launched from a cannon under the explosive pressure of a $CO_2$ cartridge, much less by hand. Although hand launching has been proposed in U.S. Pat. No. 5,556,319, many problems have been encountered, particularly in launching multiple streamers by hand.

SUMMARY

The above-indicated problems are solved by the present invention in which multiple streamers of a particular design are contained in an elongated tube in a particular manner such that effective launching by hand may be achieved.

DETAILED DESCRIPTION

Figure 1:
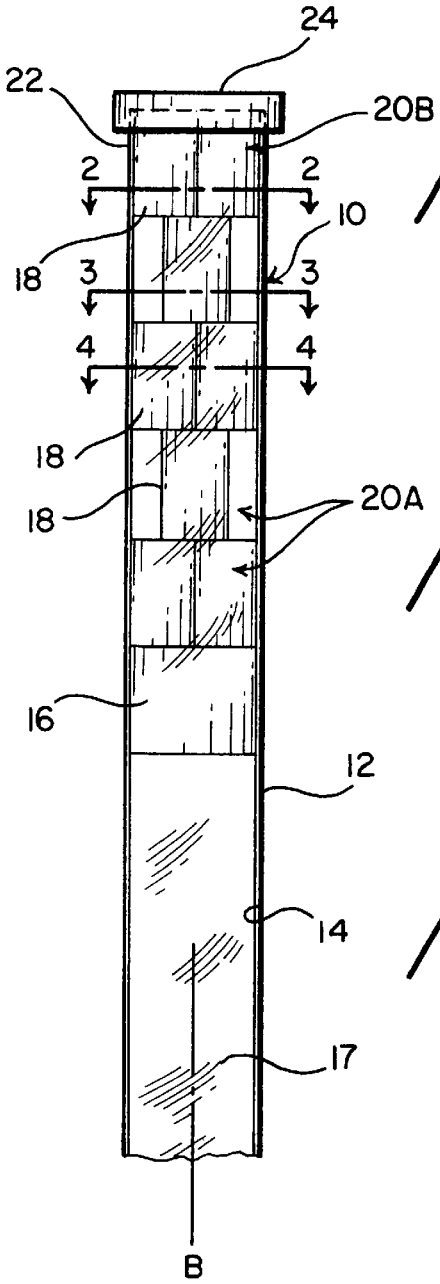
FIG. 1 is a side elevational view of the invention with the launching tube shown as being composed of a clear material.
Figure 2:
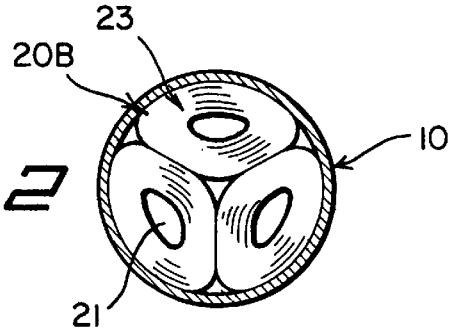
FIGS. 2–4 are cross-sectional views taken along view lines 2, 3 and 4 of FIG. 1, respectively.
Figure 3:
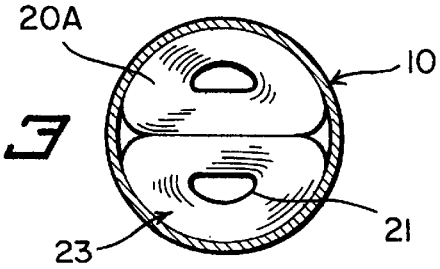
Figure 4:
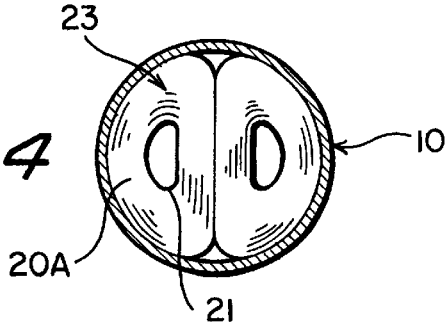

FIG. 1 illustrates an elongated tube 10 which is composed of plastic or cardboard and has an outer surface 12 and an inner surface 14. It has been discovered that the length of the tube should be in the order of 9" to 36", and the diameter should be in the order of ½" to 2". Most preferably, it has been discovered that the length should be in the order of 12" to 24" and the diameter should be in the order of ¾" to 1½".

In one of the preferred embodiments, tube 10 includes a stopper 16 located along the longitudinal length of the tube. Stopper 16 may be composed of resilient material such as plastic foam or cork material, and the diameter of stopper 16, when outside of the tube, is equal to or may be greater than the internal diameter of the tube. If the stopper is equal to or less than the internal tube diameter, the stopper may be glued or stapled in position. Therefore, once the stopper has been positioned in the tube, it remains stationary under the centrifugal force developed during the curved motion of the tube to eject streamers. Stopper 16 is preferably positioned at least ¼ of the tube length inwardly from either end, and preferably at about the mid-point of the tube.

As shown in FIGS. 1 to 5, the upper portion of tube 10 contains a plurality of wound streamers 18 having hollow cores 21. In this embodiment, streamers 18 are arranged in a particular arrangement which preferably comprises one or more rows of one or two streamers 20A. Additionally, at least one row of three or more streamers 20B are located at or toward outlet end 22 relative to the one or more rows of streamers 20A. In this arrangement, it has been discovered that the row or rows of three or more streamers 20B acts as a plug such that they maintain themselves, and the one or more rows of streamers 20A, within the tube even if end 22 is pointed straight downwardly with no end cap on the tube. Also, in acting as a plug of predetermined frictional force against wall 14, row 20B will not be ejected unless and until a predetermined amount of centrifugal force is generated. Such force is determined by the velocity of the arcuate motion of the upper portion of the tube as produced by the arm and wrist of the user, and the weight or mass of rows 20A in tube 10 between outlet 22 and the user's hand (not shown) located at the bottom portion 17 of the tube. Therefore, as a result of many experiments, it has been discovered that the length of the tube should be as previously described for optimum results when used by the majority of persons of average arm strength. Similarly, it has been discovered by many experiments that the previously described ranges for the diameter of tube give optimum results. In addition, it has been discovered that, in this embodiment, the total mass of rows 20A should be greater than the mass of row or rows 20B such that the mass of the former pushes all of the rows of streamers out of the tube and high into the air.

It has also been discovered that the length of the wound strip comprising the streamers should be in the preferred order of 4 to 12 feet for indoor use, and not in excess of 30 feet for outdoor use. Also, while streamers composed of wound tissue paper strips may be used, streamers composed of metalized plastic film perform substantially better, and streamers having lacquer coatings produce superior results in terms of unwinding most completely in the air as further disclosed in U.S. Pat. No. 5,620,354 incorporated by reference herein.

As previously described, it has been determined that the axial position of the stopper should be positioned at approximately the midpoint of the length of the tube. Therefore, the bottom half 17 of the tube may be left empty, as illustrated, such that the bottom portion may function only as a handle or lever to produce the desired degree of centrifugal force. However, since it has been discovered that the stopper should be positioned near the mid point, the bottom portion may contain a second set of streamers, in the same pattern as described, such that a single tube may provide two launchings instead of only one. In addition, it will be noted that, while end caps 24 may be included to close the ends of the tube, the present invention eliminates the necessity of end caps because the row or rows of streamers 20B, at one or both ends acts as a cap which maintains all of the streamers in the tube until they are launched by the user as described above.

Figure 5:
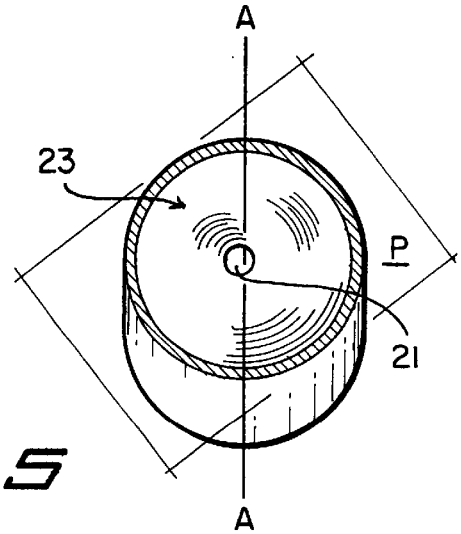
FIG. 5 a schematic illustration of one streamer illustrating the central axis and the side plane.

For purposes of further clarity and definitions, the "central axis" of a streamer is intended as the axis A—A shown in FIG. 5 which passes through the core 21 and is the central axis about which the streamer is wound. The term "side plane" is intended as the plane P which is defined as the plane of the cut side edges 23 of the streamer as also shown in FIG. 5. Thus, streamers 18 are positioned in tube 10 with their central axes parallel to the longitudinal axis B of the elongated tube, and the streamers are positioned with their side planes P perpendicular to tube axis B.

Figure 6:
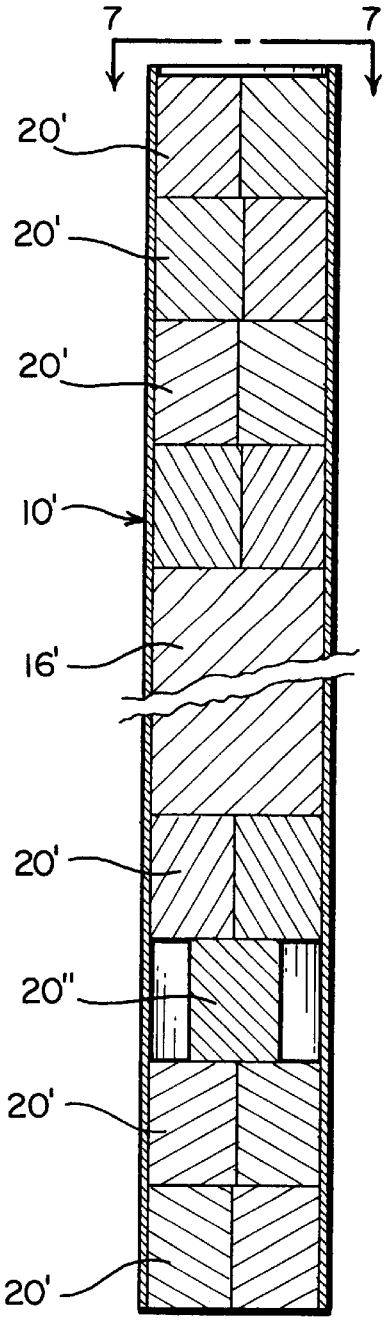
FIG. 6 is a cross-sectional view of another preferred embodiment of the invention.
Figure 7:
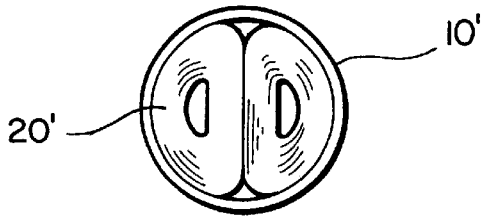
FIG. 7 is a top view looking down on the launching tube and streamers taken along view line 7—7.
Figure 8:
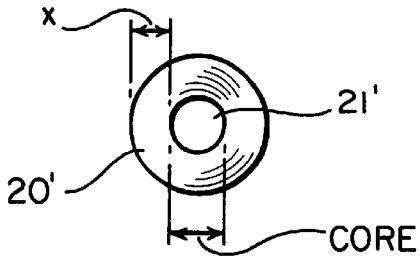
FIG. 8 is a top plan view of one streamer of the present invention when it is outside of the launching tube.

FIGS. 6–8 illustrate a second embodiment of the present invention in which at least the majority of the rows 20' of streamers are of the same number per row, and preferably 2–3 streamers per row. However, it will be understood that one or more rows, such as row 20" may be of a lesser number of streamers such as 1 or 2 streamers. However, the optimum number of streamers per row has been determined to be 2, with the total number of rows being 3 to 10.

In this embodiment, all or substantially all of the rows of streamers may have the same number of streamers such that all of the rows frictionally engage the tube wall with substantially the same force. As a result, it has been unexpectedly discovered that all of the rows of streamers may be ejected high into the air at the same time with only one arcuate hand motion of the launching tube by the user. This prevents one or more rows, such as the lowermost rows 20A of FIG. 1, from failing to be ejected with the other streamers in one simultaneous launching. For example, all eight streamers in the top of the FIG. 6 embodiment may be ejected in a more spectacular display.

A number of factors have been determined to be involved in the unexpected ability of the FIG. 6 embodiment to obtain this simultaneous launch of virtually all streamers. For example, it has been discovered that the streamers should have significantly enlarged hollow cores 21' relative to the FIGS. 1–5 embodiment. That is, the hollow cores 21' should be at least 3/16 of an inch in diameter, and preferably between ¼ and ½ of an inch. With such enlarged hollow cores it has been discovered that the streamers become exceptionally resilient when the streamers are squeezed and loaded into the tube as shown in FIG. 7. As a result, this resiliency is sufficient to maintain the streamers in the tube even if the tube is pointed straight downwardly without a cap. Also, in the most preferred embodiment, all or substantially all of the streamers should have external surfaces of plastic, and preferably plastic surfaces with a lacquer coating so as to reduce the friction between the streamer surfaces and the interior of the launching tube. In this regard, it has been discovered that this lower degree of frictional contact with the internal wall of the tube; i.e., as opposed to the use of tissue paper streamers, is more than compensated for by the substantially increased resiliency of each of the streamers with the larger cores. That is, the larger hollow cores are compressed and essentially flattened when they are loaded into the launching tube. As such, they become highly resilient, and this resiliency is sufficient to retain the streamers in the tube until the maximum centrifugal force is generated by the arm and wrist of the user. For maximum resiliency, the streamer should be composed of a wound plastic strip, and for a lesser degree of resiliency, a wound strip of tissue paper may be used.

In the preferred embodiment of FIGS. 6–8 it has also been discovered that the optimum results are obtained when the radial thickness x of one-half of the wound part of the streamer is less than the diameter of the open, hollow core 21'. That is, for example, if the hollow core 21' is ¼ inch, the thickness x should be less than ¼ inch. As a further example, if the diameter of the open core 21' is in the order of ½ inch, the thickness x of the wound portion should be in the order of ⅛ to ½ inch. Therefore, it has been discovered that for the optimum results in terms of ejecting all streamers at once, and propelling them to the highest point in the air, the diameter of the open hollow cores 21' should be in the range of about ¼ to ½ inch, and preferably in the order of ⅜ inch, and the thickness x should be equal to or less than the respective diameter of the hollow core.

Figure 9:
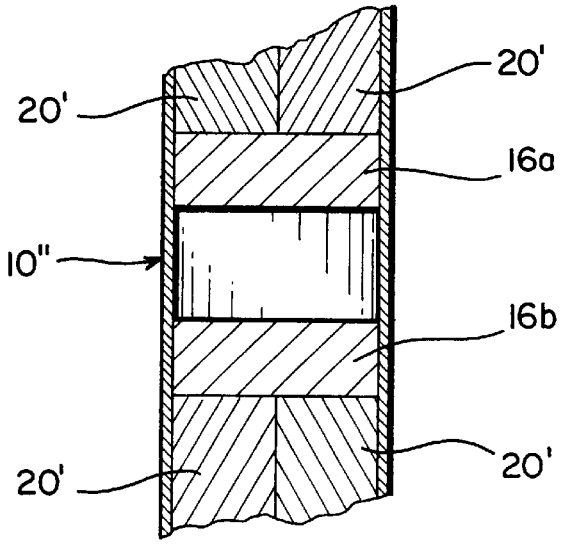
FIG. 9 is a fragmentary view showing an alternative form of stopper.

It has also been discovered that stopper 16 of the FIG. 1 embodiment may be used to determine the internal length of the launching tube, and may be composed of separate spacers 16*a–b* as shown in FIG. 9. Thus, the length of the spacer may be used to determine the optimum number of rows of streamers for a tube of given length. That is, it has been determined that in general, the axial length of the stopper should be in the order of 5 to 30% of the total length of the launching tube, and that 3 to 10 rows of streamers should be positioned above and below the stopper for an optimum aerial display. In this manner, a launching tube of the preferred 12 to 24 inch length may have only a few rows of streamers above and below the stopper, such as two to five rows for example, while still providing a total length of launching tube so as to easily generate the necessary centrifugal force by the average person.

Of course, it will be understood that the foregoing description of two preferred embodiments is intended to be illustrative of the principles of the invention, and not exhaustive thereof, and that the true scope of the invention is determined by the following claims interpreted under the Doctrine of Equivalents.

What is claimed is:

1. A non-explosive system for hand launching streamers from a hollow tube comprising:

(a) an elongated hollow launching tube having an open end when launching streamers;

(b) a plurality of spiral wound streamers positioned in said launching tube;

(c) said streamers being positioned in rows along the length of said launching tube;

(d) at least the streamers in the row closest to said open end having open hollow cores before insertion into said launching tube and collapsed cores when inserted into said launching tube so as to bias said streamers radially outwardly and form a frictional resistance against ejection of said streamers from said tube; and (e) wherein at least said streamers in the row closest to said open end have central axes about which said streamers are wound, and wherein said central axes are oriented parallel to each other.

2. The non-explosive launching system of claim 1 wherein said elongated hollow launching tube has a longitudinal axis, and wherein said central axes of said streamers are parallel to said longitudinal axis of said tube.

3. The non-explosive launching system of claim 2 wherein the central axes of all of said streamers in said launching tube are parallel to said longitudinal axis of aid tube.

4. The non-explosive launching system of claim 1 wherein the number of streamers in each of said rows is the same.

* * * * *